US006520825B1

(12) United States Patent
Herr

(10) Patent No.: US 6,520,825 B1
(45) Date of Patent: Feb. 18, 2003

(54) PARADE THROW

(75) Inventor: Lisa Montelepre Herr, Kenner, LA (US)

(73) Assignee: Kenner Innovative Design Systems, L.L.C., Kenner, IA (US)

( * ) Notice: Subject to any disclaimer, the term of this patent is extended or adjusted under 35 U.S.C. 154(b) by 0 days.

(21) Appl. No.: 09/850,812

(22) Filed: May 8, 2001

Related U.S. Application Data

(60) Provisional application No. 60/218,900, filed on Jul. 18, 2000.

(51) Int. Cl.[7] ..... A63H 33/00

(52) U.S. Cl. ..... 446/71; 383/4; 446/73; 446/51; 273/286

(58) Field of Search ..... 446/475, 42, 44, 446/45, 46, 49, 51, 71–73, 75–76, 80, 487–488; 383/4; 273/285–87

(56) References Cited

U.S. PATENT DOCUMENTS

| | | | | | |
|---|---|---|---|---|---|
| 2,493,085 | A | | 1/1950 | Pincus | 150/1.7 |
| 2,682,290 | A | * | 6/1954 | Ditlea | |
| 4,201,009 | A | | 5/1980 | Burridge, Jr. | 46/1 |
| 4,290,226 | A | | 9/1981 | Stauffer | 46/74 |
| 4,709,928 | A | | 12/1987 | Willingham | 273/309 |
| 4,752,267 | A | | 6/1988 | Layman | 446/46 |
| 5,152,612 | A | * | 10/1992 | Shoemaker | 383/6 |
| 5,287,561 | A | | 2/1994 | Spector | 2/209 |
| 5,297,872 | A | * | 3/1994 | Caligiuri | 383/86 |
| 5,421,584 | A | * | 6/1995 | Planinc et al. | 273/327 |
| 6,019,244 | A | | 2/2000 | Jones | 220/666 |
| 6,083,128 | A | * | 7/2000 | Young et al. | 473/576 |

* cited by examiner

*Primary Examiner*—Derris H. Banks
*Assistant Examiner*—Jamila Williams
(74) *Attorney, Agent, or Firm*—Garvey, Smith, Nehrbass & Doody, L.L.C.; Charles C. Garvey, Jr.

(57) ABSTRACT

A parade throw and its method of use are disclosed. The parade throw includes a bag having an open top and a contained support member that can be in the form of a disk, ring, or plastic "Frisbee®" like member. The combination of bag and support disk are assembled together. In one embodiment, the disk is hollow, providing a hollow interior or cavity that can receive substantially all of the bag for storage when it is to be thrown. The disk can be made of cardboard or other disposable material so that the user simply removes the internal support and uses the bag for storing articles once it is retrieved. In other embodiments, the support disk may be in the form of a toy that can be a throwable disk or ring.

25 Claims, 8 Drawing Sheets

PARADE THROW

CROSS-REFERENCE TO RELATED APPLICATIONS

Priority of U.S. Provisional Patent Application Serial No. 60/218,900, filed Jul. 18, 2000, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to parade throws and related articles that are designed to be thrown during sporting events, spectator events, conventions, and the like. More particularly, the present invention relates to a throw that features a disk like support structure fitted within or around a collapsible bag, the combination being thrown from a parade float, or into spectator stands.

2. General Background of the Invention

Many parade events have throws that are hurled by the parade participants to onlookers. At sporting events such as football games, basketball games, hockey games, etc., articles are frequently thrown from the field or court into the stands and to the spectators.

BRIEF SUMMARY OF THE INVENTION

The present invention provides a unique parade throw that can be thrown to onlookers at a parade, to attendees at a convention, or to spectators at sporting events.

The apparatus includes a collapsible bag that folds and conforms to an internal/external disk like support member so that the combination of support member and bag form a disk that can be thrown and will soar.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
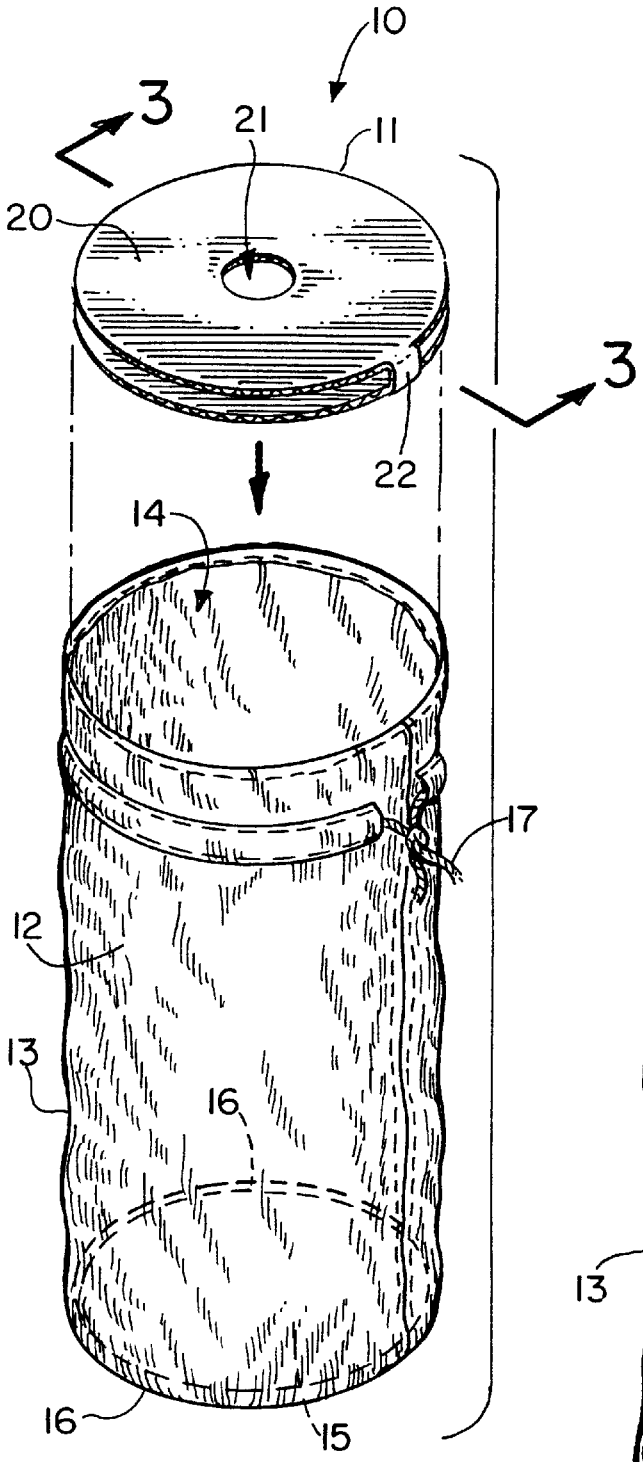
FIG. 1 is a perspective exploded view of the preferred embodiment of the apparatus of the present invention showing the bag and disk portions prior to assembly.
Figure 2:
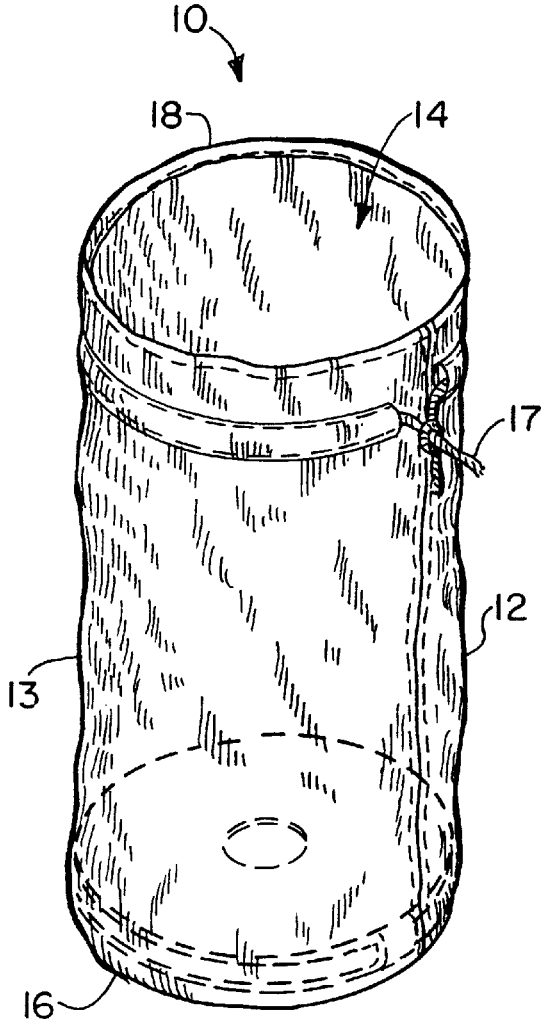
FIG. 2 is a perspective view of the preferred embodiment of the apparatus of the present invention showing the disk at the bottom of the bag, with the bag in an extended, open position.
Figure 3:
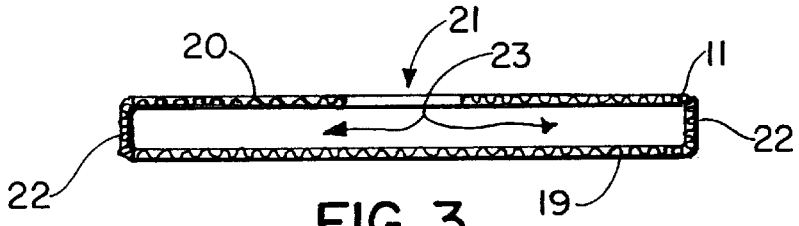
FIG. 3 is a sectional view taken along lines 3—3 of FIG.

FIGS. 1 through 3 show the preferred embodiment of the apparatus of the present invention designated generally by the numeral 10 in FIGS. 1 and 2. Parade throw 10 includes a support disk 11 contained within a collapsible bag 12. Bag 12 has cylindrical wall 13, open top 14 and bottom panel 15. The bottom panel 15 can be connected to the cylindrical wall 13 using a stitched connection 16, as an example.

After the parade throw 10 is caught by a spectator, the support disk 11 can optionally be removed or discarded. Bag 12 can then be used by the spectator for storage purposes. Bag 12 can provide a drawstring 17 for use in closing the open top 14 when the bag is filled with other carnival throws, parade throws or a user's paraphernalia. The open top 14 is surrounded by edge 18 at the upper end of cylindrical wall 13. The drawstring 17 can be positioned at or next to upper edge 18 as shown in FIGS. 1 and 2.

In FIGS. 1 and 3, support disk 11 includes bottom panel 19, top panel 20, and can include a pair of optional support spacers 22. Top panel 20 preferably has a centrally located opening 21 that is sized large enough so that the bag 12 can fit through opening 21 for storage within hollow interior 23.

Figure 4:
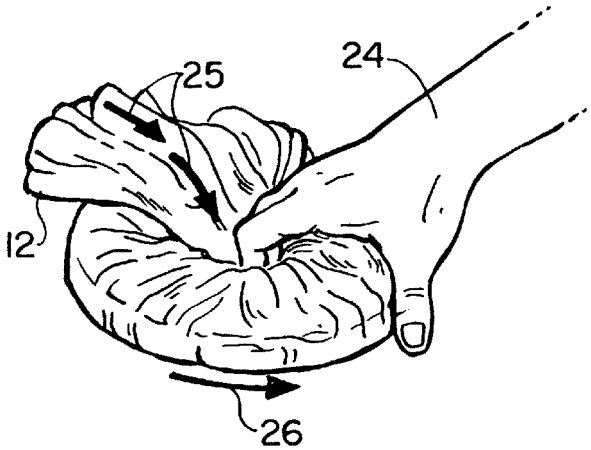
FIG. 4 is a perspective view of the preferred embodiment of the apparatus of the present invention showing the bag being conformed to and inserted into the interior of the disk support.
Figure 5:
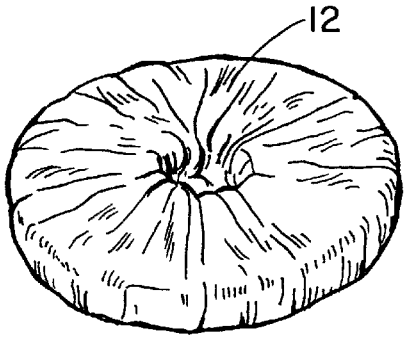
FIG. 5 is a perspective view of the preferred embodiment of the apparatus of the present invention shown in the throwing, folded position.

Hollow interior 23 is large enough to contain bag 12 when most of the sidewall 13 of the bag 12 is pushed into interior 23 as shown in FIGS. 4 and 5. In such a situation, the bottom panel 15 of bag 12 registers against and fits closely to the bottom panel 19 of disk 11. During insertion of the bag 12 as shown in FIG. 4, arrows 25 indicate schematically the gradual insertion of bag 12 into interior 23 (in the direction of arrows 25) and while the user 24 simultaneously rotates the disk 11 in the direction of arrow 26 as an example.

Figure 6:
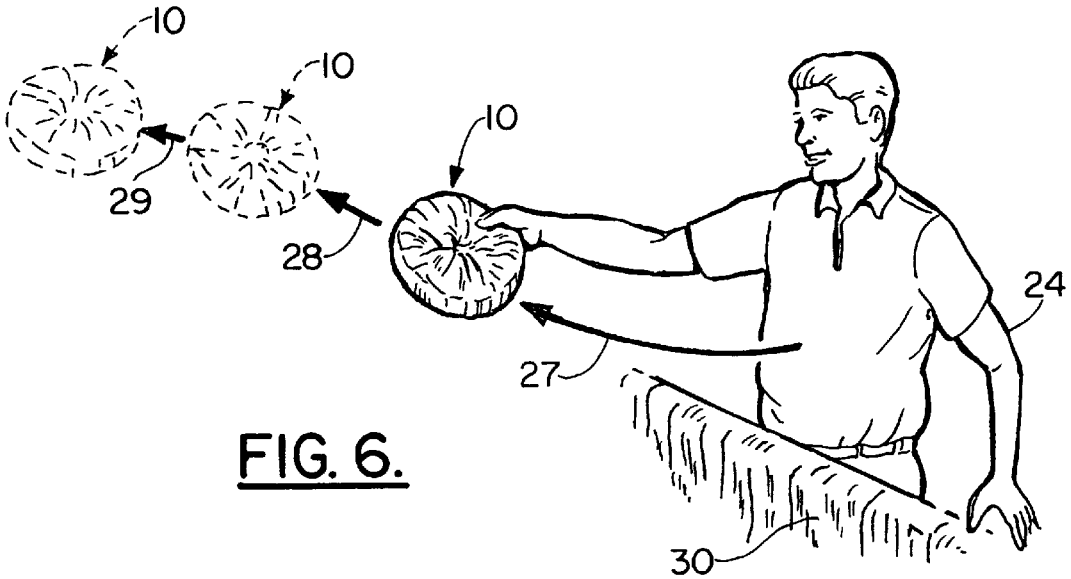
FIG. 6 is a perspective view of the preferred embodiment of the apparatus of the present invention, and illustrating the method of the present invention.

In FIG. 6, the method of the present invention is illustrated wherein a user 24 throws the combination of bag 12 and disk 11 from a parade float 30, the throwing motion being indicated schematically by the numeral 27. The flight of the combination of support disk 11 and bag 12 comprising parade throw 10 is schematically indicated by the arrows 28, 29.

Figure 7:
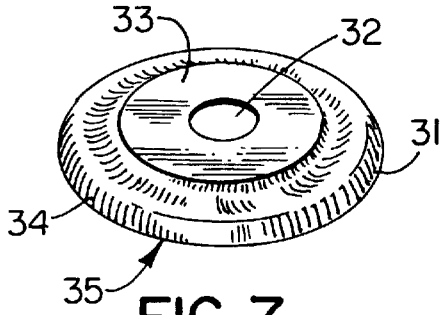
FIG. 7 is a partial perspective view of an alternate embodiment of the apparatus of the present invention.
Figure 8:
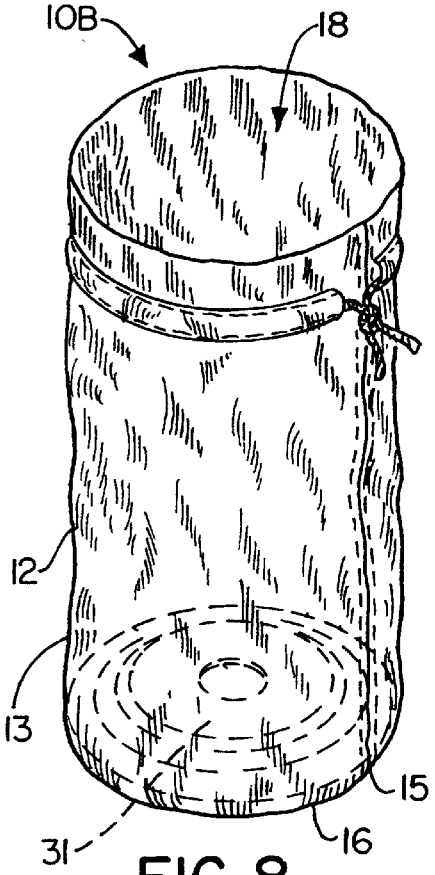
FIG. 8 is a perspective view of the alternate embodiment of the apparatus of the present invention showing the bag in an extended, open position and with the disk support member at the bottom of the bag shown in phantom lines.
Figure 9:
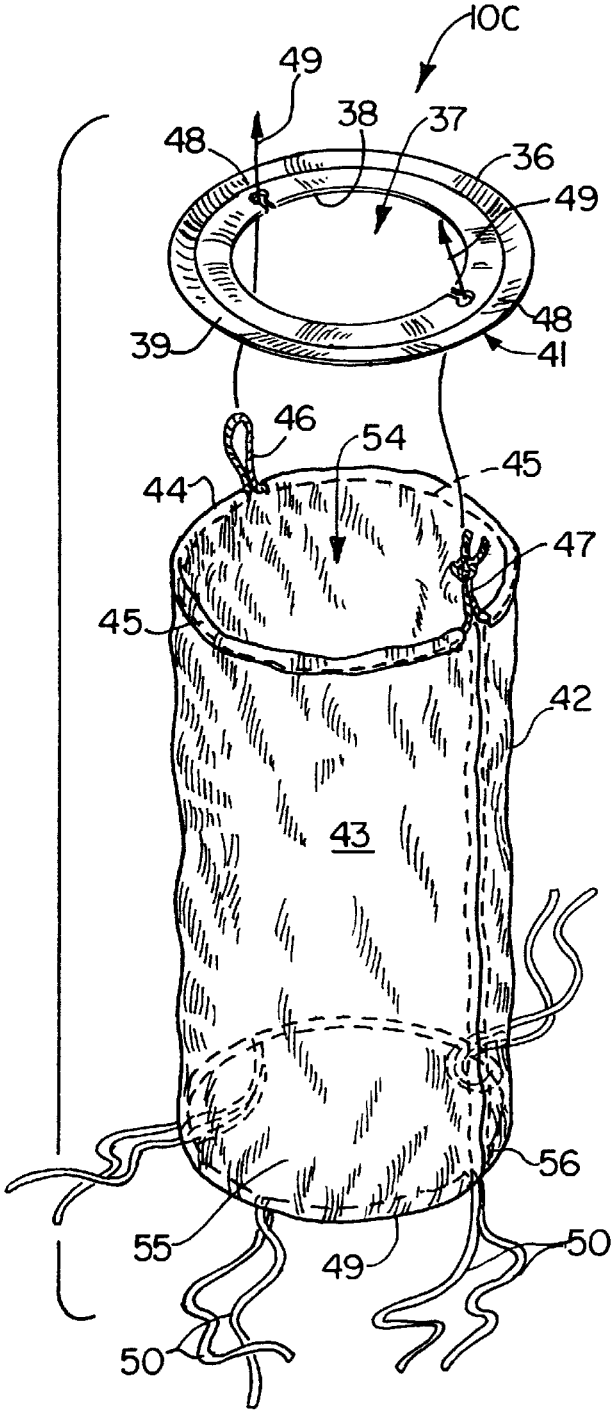
FIG. 9 is a perspective, exploded view of a third embodiment of the apparatus of the present invention.

In FIGS. 7 and 8, a second embodiment of the apparatus of the present invention is shown, designated generally by the numeral 10B in FIG. 8. In the embodiment of FIGS. 7 and 8, a plastic disk 31 is used as the internal support in place of support disk 11. The plastic disk 31 can be of an injection molded plastic material preferably of a generally uniform thickness, having a central opening 32 that corresponds in size and shape to the opening 21 of the disk 11 in FIG. 3. Plastic disk 31 has an upper flat surface 33 at the central portion of the disk, surrounding central opening 32.

At the periphery of plastic disk 31 is provided convex peripheral upper surface 34 and concave peripheral undersurface 35. Otherwise, the bag 12 is of the same construction as that shown with respect to the embodiment of FIGS. 1–6. The user tucks the upper edge 18 of bag 12 though the center 32 of disk 31 and to the underside of the disk 31 so that the majority of the bag 12 including substantially all of its cylindrical wall 13 fits through the opening 32 and into the space in between disk 31 and bottom panel 15 of bag 12.

Disk 31 can be plastic, and can be replaced with an internal support structure made of any suitable material including but not limited to cardboard, foam, Styrofoam or the like that supports the bag sufficiently. Alternate disk configurations can be used.

FIGS. 9–12 show a third embodiment of the apparatus of the present invention designated generally by the numeral 10C. In FIGS. 9–12, a ring 36 attaches to a bag 42 that has an open top 54. Ring 36 has a large open center 37, inner edge 38, convex upper surface 39, and concave undersurface 40. A peripheral edge 41 defines the outer dimension of ring 36. Bag 42 has a cylindrical side wall 43, upper edge 44, lower edge 49, and an open top 54 and bottom panel 55. A stitched connection 56 can be used to join bottom panel 55 to edge 49 of sidewall 43. A drawstring 45 is provided at open top 54, the drawstring having a spaced apart ties 46, 47 that can be used to tie ring 36 to bag 42 at open top 54. In that regard, ring 36 provides a pair of spaced apart openings 48 that are positioned to form a connection with the ties 46, 47 of drawstring 45.

Figure 10:
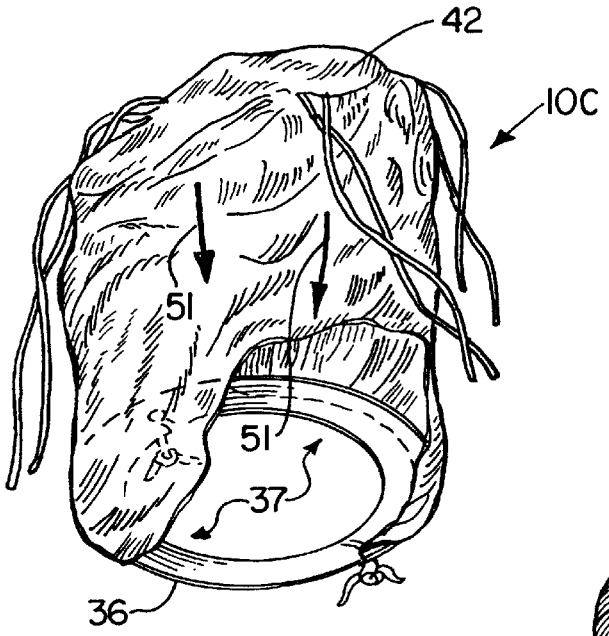
FIG. 10 is a perspective view of the third embodiment of the apparatus of the present invention in an open position.
Figure 11:
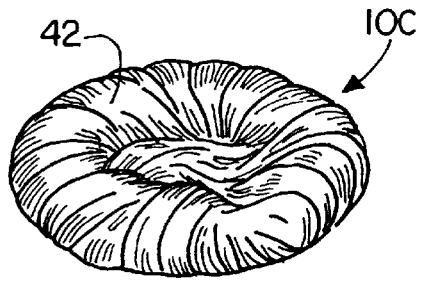
FIG. 11 is a perspective view of the third embodiment of the apparatus of the present invention shown in a throwing, folded position.

Optional streamers 50 can be positioned along lower edge 49 at bottom panel 55. In FIG. 10, arrows 51 schematically indicate the folding of bag 42 about ring 36. Bag 42 is simply collapsed upon and folded about the top and periphery of ring 36 and may be encased in a disposable plastic wrapper until use. Its configuration is generally shown in FIG. 11 at the time it is to be thrown.

Figure 12:
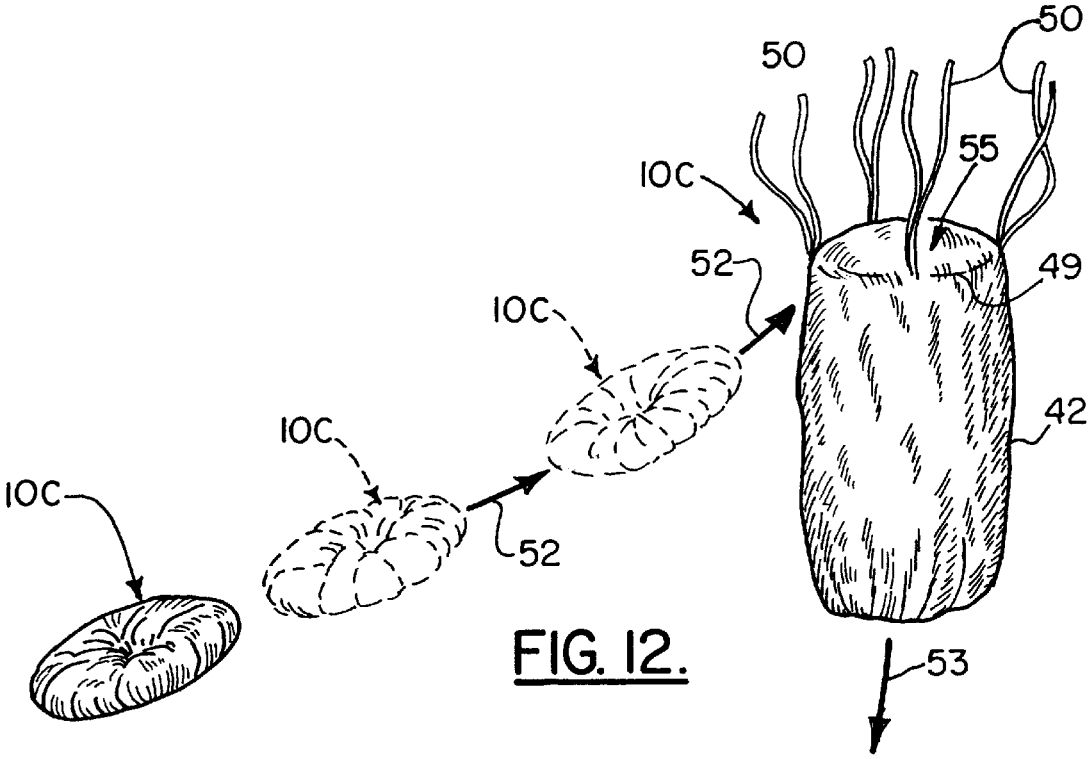
FIG. 12 shows the third embodiment of the apparatus of the present invention in a sequential view that illustrates throwing and opening of the bag at the end of a throw and an alternate method of the present invention.

In FIG. 12, the parade throw 10C is shown being thrown, schematically indicated by the arrows 52. Because the bottom of parade throw 10C is open, the centrifugal force of throwing the parade throw 10C opens the bag 42 to the position shown in FIG. 12. In the position shown in FIG. 12, the streamers 50 create a drag. This drag in combination with the weight of ring 36 causes the bag 42 to open to the position shown in FIG. 12. The arrow 53 schematically indicates the slow descent of the apparatus of 10C once it has been thrown and has opened. The bag 12 or 42 can be modified to allow attachment of lights, reflective stickers, or other decorative ornamentation.

Figure 13:
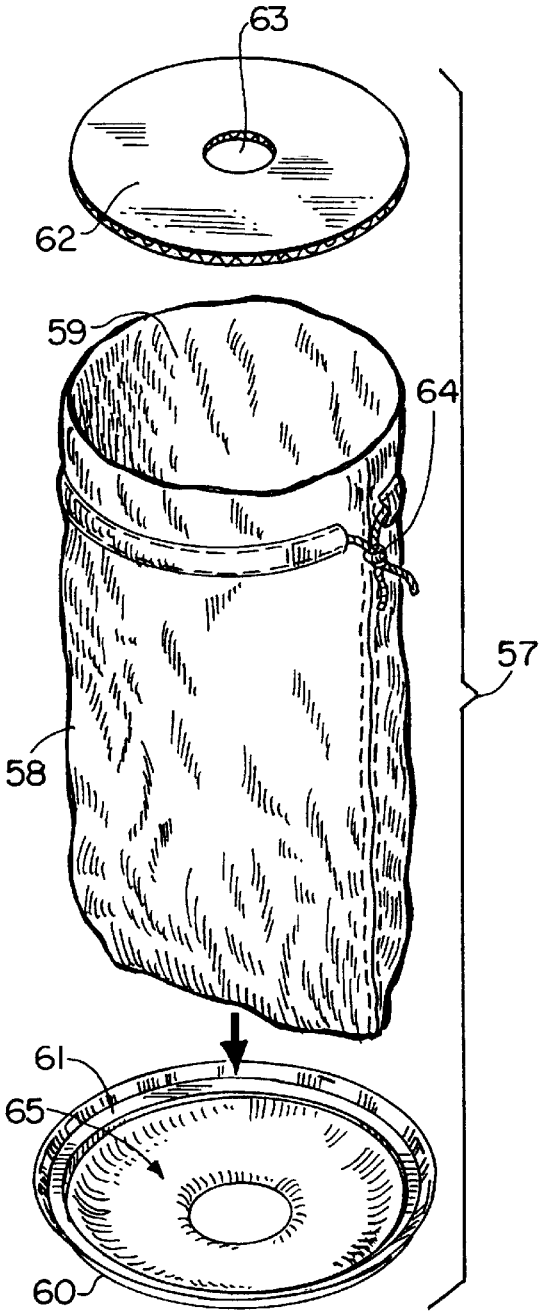
FIG. 13 is an exploded view of a fourth embodiment of the apparatus of the present invention.
Figure 14:
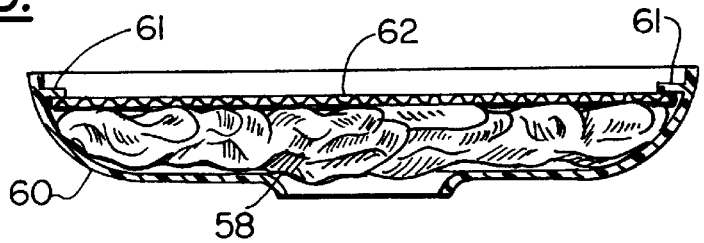
FIG. 14 is a sectional elevation view of the fourth embodiment of the apparatus of the present invention.

FIGS. 13 and 14 show a fourth embodiment of the apparatus of the present invention, designated generally by the numeral 57. The parade throw 57 includes a bag 58 having an open top 59. The bag 58 can be provided with a drawstring 64 at or next to the open top 59.

A throwable disk 60 is shown upside down in both FIGS. 13 and 14. For purposes of illustration, the upside down disk 60 is shown in the position that allows a bag 58 to be collapsed and stored in the concavity 65 of disk 60 as shown in FIG. 14. In order to retain the bag 58 within the concavity 65 of disk 60, plate 62 fits under annular flange 61 as shown in FIG. 14. The plate 62 can be provided with a central opening 63 that enables a user to grasp the plate 62 at opening 63 and pull it physically from its connection to disk 60 at annular flange 61. The bag 58 can then be removed and used to contain throws such as toys, beads, coins and the like.

Figure 15:
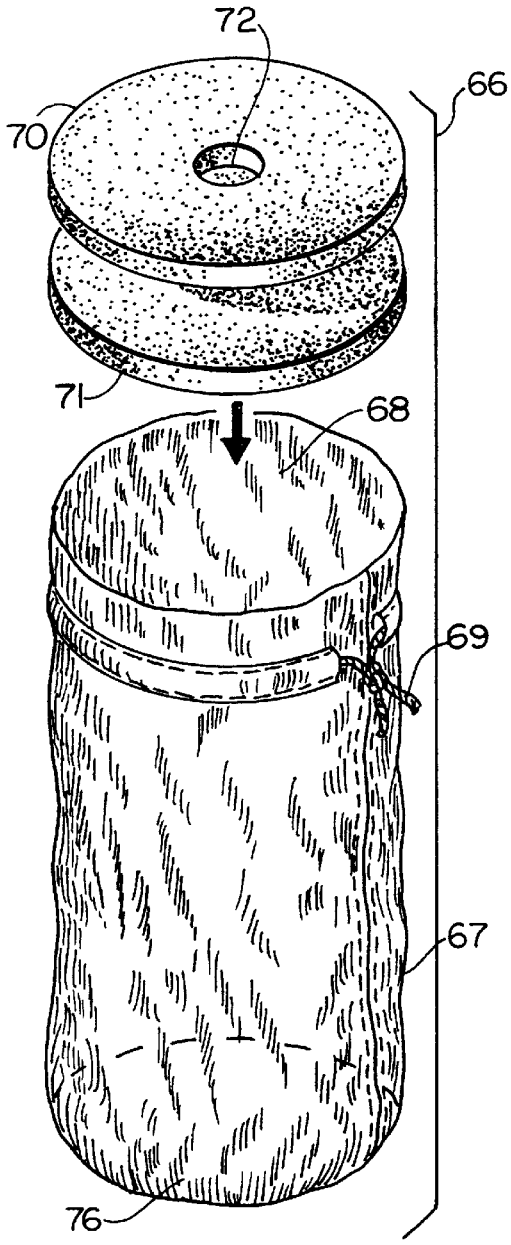
FIG. 15 is an exploded view of a fifth embodiment of the apparatus of the present invention.

FIGS. 15–19 show a fifth embodiment of the apparatus of the present invention designated generally by the numeral 66. In FIGS. 15–19, a bag 67 provides an open top 68 and can be provided with a drawstring 69 at or next to the open top 68. A pair of plates 70, 71 are placed inside the bag 67 near the bottom of the bag as shown in FIG. 15.

Figure 16:
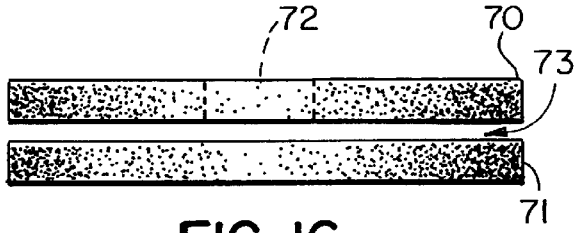
FIG. 16 is a fragmentary sectional view of the fifth embodiment of the apparatus of the present invention.
Figure 18:
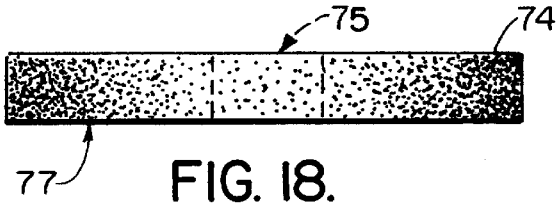
FIG. 18 is a sectional view of the fifth embodiment of the apparatus of the present invention showing a different disk arrangement.
Figure 19:
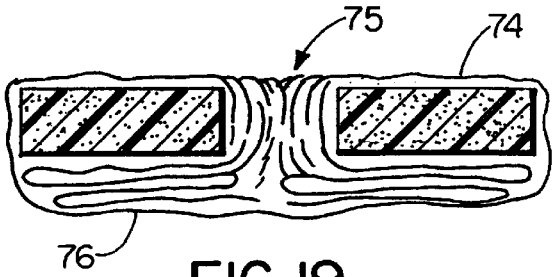
FIG. 19 is a sectional view of the fifth embodiment of the apparatus of the present invention showing a different arrangement for the disk.
Figure 21:
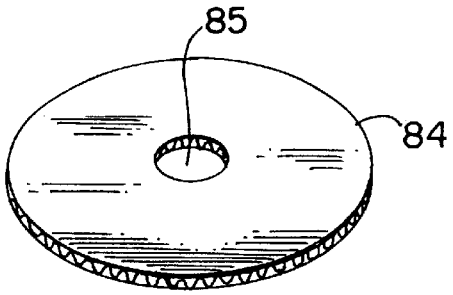
FIG. 21 is a fragmentary perspective view of the disk that is used with the sixth embodiment of the apparatus of the present invention.
Figure 20:
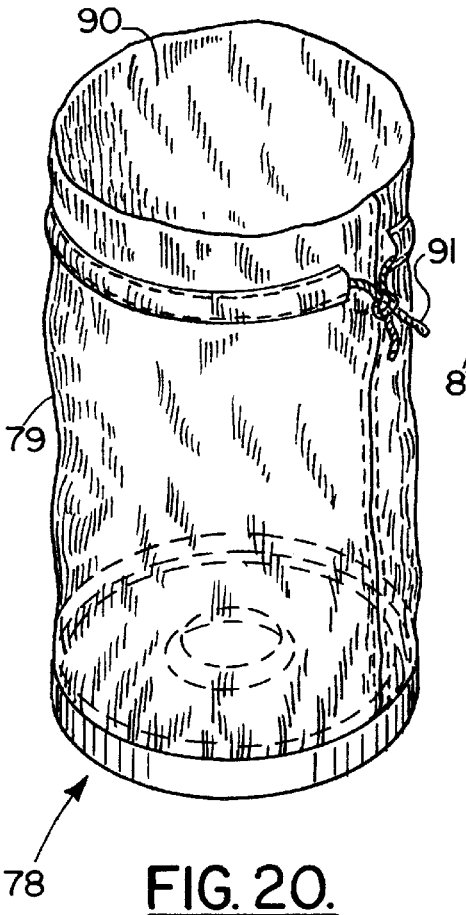
FIG. 20 is a partial perspective view of a sixth embodiment of the apparatus of the present invention.

Plate 70 has a central opening 72. The plates 70, 71 can be constructed of any suitable material including but not limited to paper, cardboard, Styrofoam, foam or the like that supports the bag sufficiently. The plates 70,71 are initially positioned in generally parallel, spaced apart relation (as shown in FIG. 16) at the bottom of the bag 67. The plate 71 is placed in the very bottom of the bag 67. The plate 70 is positioned just above the plate 71. The bag 67 is then tucked beginning at its top 68 through opening 72 and into a void space 73 in between the plates 70, 71. In FIGS. 18 and 19, a single plate 74 is used having a central opening 75.

Figure 17:
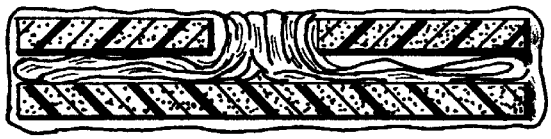
FIG. 17 is another fragmentary sectional view of the fifth embodiment of the apparatus of the present invention.

In FIG. 19, the top 68 of the bag 67 is tucked through the opening 75 and stored in between the bottom 76 of the bag 67 and the bottom 77 of the disk 74. In FIGS. 17 and 19, the parade throw 66 is shown in its completed folded position when it is ready to be thrown to a spectator of a parade, sporting event, spectator event or the like.

Figure 22:
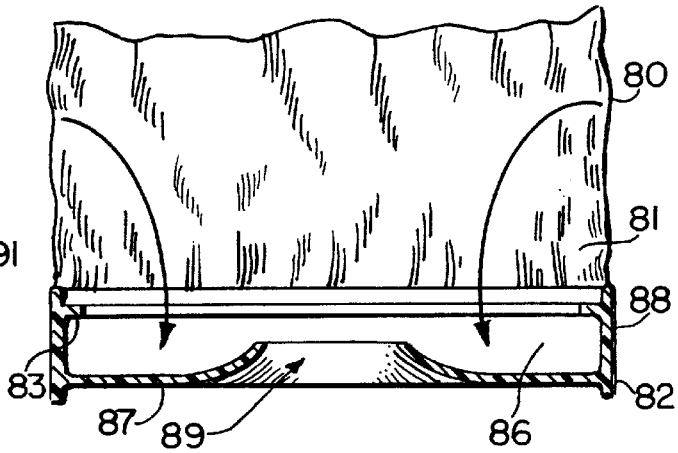
FIG. 22 is a sectional view of the sixth embodiment of the apparatus of the present invention.
Figure 23:
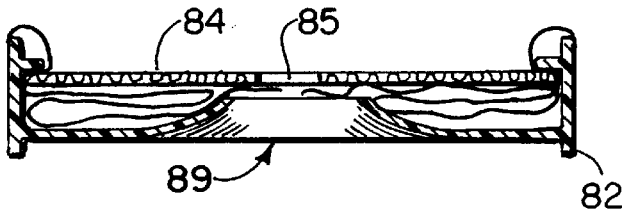
FIG. 23 is another sectional view of the sixth embodiment of the apparatus of the present invention.

FIGS. 20–23 show a sixth embodiment of the apparatus of the present invention designated generally by the numeral 78. In the embodiment of FIGS. 20–23, a bag 79 has a flexible bag wall 80 with a lower end portion 81 to which is attached a rigid throwable disk member 82. The disk 82 has an annular flange 83 that receives plate 84. The plate 84 has opening 85 enabling it to be quickly grasped and removed by a recipient. In FIGS. 22 and 23, the user collapses the flexible wall 80 of bag 79 into the space 86 defined by the bottom 87 and side wall 88 of rigid disk member 82. Bottom 87 may have a concavity 89 that helps the rigid member fly when it is hurled by a user and simultaneously spun as simulated in FIG. 6. Bag 79 can provide an open top 90 and drawstring 91 so that it can be opened and used to store articles such as parade throws, beads, toys, coins and the like. Drawstring 91 can be located at or near upper edge 90.

Figure 24:
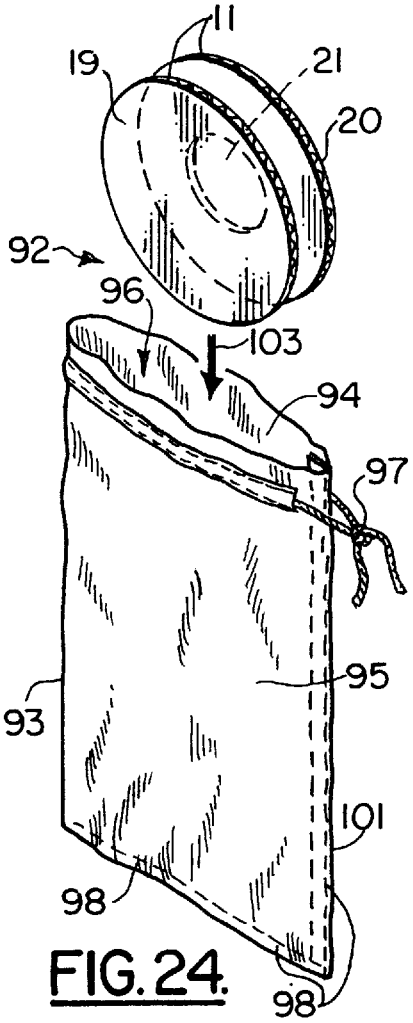
FIGS. 24–27 show an alternate method of configuring the apparatus of the present invention and showing a seventh embodiment of the apparatus of the present invention.
Figure 25:
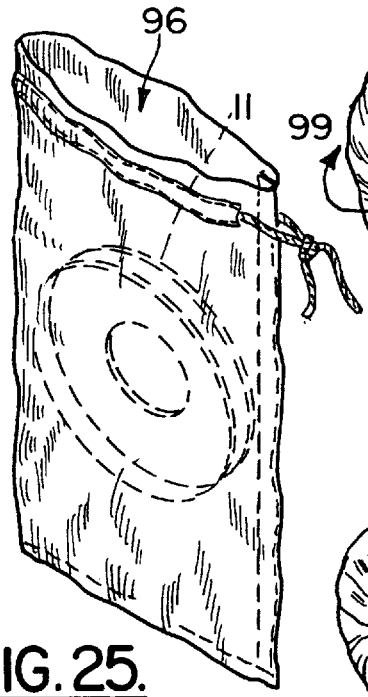
Figure 26:
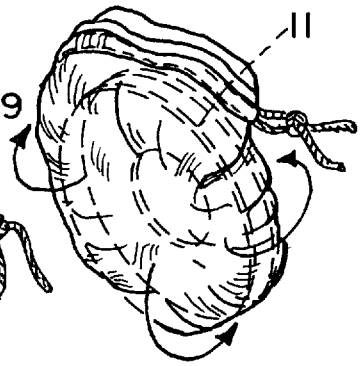

FIGS. 24–26 show a parade throw 92 that includes a generally flat bag 93 having opposed side walls 94, 95 and an open top 96. A drawstring 97 can be used for closing the open top 96. Stitching 98 can be used along one edge 101 and at bottom 102 for forming a closure.

Figure 27:
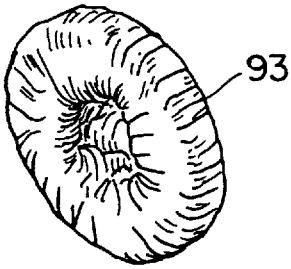

As the bag 93 is generally flat, a disc like throwable parade throw 92 is produced by placing support disc 11 inside bag 93 by inserting it through open top 96 as indicated by arrow 103 in FIG. 24. The panel 20 of disc 11 having opening 21 is placed against a selected side wall such as side wall 94. The bag 93 has been folded around the disc 11 and stuffed into opening 21 as shown in FIGS. 26 and 27.

Figure 28:
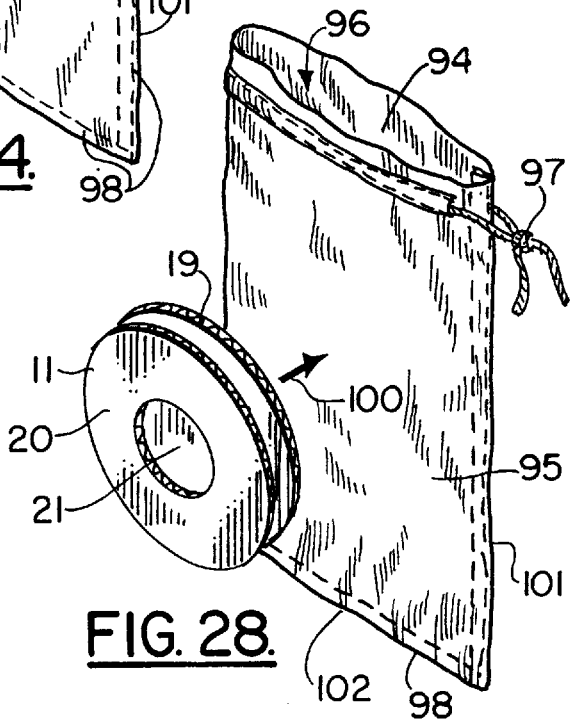
FIGS. 28–29 show the seventh embodiment of the apparatus of the present invention and an alternate method of configuring the apparatus.
Figure 29:
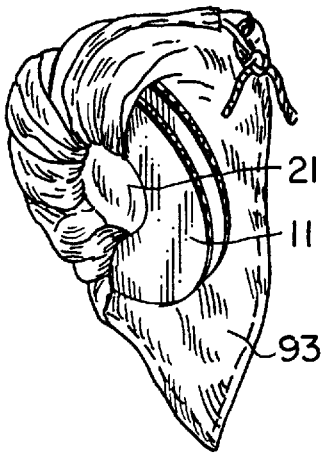

In FIGS. 28–29, the same bag 93 can be used to form a throwable parade throw 92 by placing the disc 11 on the outside of the bag 93 such as against side panel 95 and with opening 21 facing away from side panel 95 as indicated by arrow 100 in FIG. 28. A user then folds the bag 93 about the disc 11 and stuffs the periphery of the bag between the panels 19, 20 of disc 11 through opening 21 as shown in FIG. 29.

The following is a list of suitable parts-and materials for the various elements of the preferred embodiment of the present invention.

PARTS LIST

Part Number: Description

10 parade throw
10B parade throw
10C parade throw
11 support disk
12 bag
13 cylindrical wall
14 open top
15 bottom panel of bag
16 stitched connection
17 drawstring
18 upper edge
19 bottom panel
20 top panel
21 central opening
22 optional support spacers
23 hollow interior
24 user
25 arrow
26 arrow
27 arrow
28 arrow
29 arrow
30 parade float
31 plastic disk
32 central opening
33 upper flat surface
34 convex peripheral upper surface
35 concave peripheral undersurface
36 ring
37 large open center
38 inner edge
39 convex upper surface
40 concave undersurface
41 peripheral edge
42 bag
43 cylindrical sidewall
44 upper edge
45 drawstring
46 tie
47 tie
48 opening
49 lower edge
50 streamer
51 arrow
52 arrow
53 arrow
54 open top
55 bottom panel
56 stitched connection
57 parade throw
58 bag
59 open top
60 throwable disk
61 annular flange
62 plate
63 opening
64 drawstring
65 concavity
66 parade throw
67 bag
68 open top
69 drawstring
70 plate
71 plate
72 opening
73 void space
74 plate
75 opening
76 bottom
77 bottom surface
78 parade throw
79 bag
80 flexible wall
81 lower end portion
82 rigid member
83 annular flange
84 plate
85 opening
86 void space
87 bottom
88 side wall
89 concavity
90 open top
91 drawstring
92 parade throw
93 bag
94 side wall
95 side wall
96 open top
97 drawstring
98 stitching
99 arrow
100 arrow
101 edge
102 bottom
103 arrow The foregoing embodiments are presented by way of example only; the scope of the present invention is to be limited only by the following claims.

What is claimed is:

1. A parade throw comprising:

a) a collapsible bag having side wall portions, a bottom and an open top;

b) an insert having a central opening, an outer surface that includes a top surface and a bottom surface, and an interior storage area that contains at least a majority of the bag when the bag is collapsed;

c) the bag and insert being configured to connect together wherein part of the bag is inserted into the interior storage area via the central opening and part of the bag covers the outside surface of the insert, the combination of the so connected bag and insert being in the shape of a throwable disk.

2. The parade throw of claim 1 wherein the insert is sized and shaped to fit completely inside the collapsible bag.

3. The parade throw of claim 1 wherein the insert and the bag each have diameters that are about equal.

4. The parade throw of claim 1 wherein the insert is sized and shaped to conform generally to the bottom of the bag when placed inside the bag.

5. The parade throw of claim 1 wherein the insert is comprised of two generally circular spaced apart panels with a space there between, said central opening being on one of said panels.

6. The apparatus of claim 1 wherein the insert is permanently attached to the bag.

7. A parade throw comprising:

a) a collapsible bag having a side wall, bottom and open top;

b) an insert having a receptacle space that is sized and shaped to receive and store a part of the bag;

c) the insert having at least a central opening and an outer surface that includes a top surface and a bottom surface;

d) the bag and insert being configured to fit together with the bag being positioned next to the bottom surface of the insert, and a portion of the bag being insertable into the receptacle space via the central opening, so that the combination of bag and insert can be configured in the shape of a throwable disk; and e) wherein a portion of said side wall of the collapsible bag is stored in a space in between the bottom of the bag and the bottom surface of the insert, and a part of the bag completely envelops the insert.

8. The parade throw of claim 7 wherein the insert is sized and shaped to fit inside the bag.

9. The parade throw of claim 7 wherein the insert and the bag each have diameters that are about equal.

10. The parade throw of claim 7 wherein the insert is sized and shaped to conform generally to the bottom of the bag when the insert is placed inside the bag.

11. A parade throw comprising:

a) a collapsible bag having a side wall, bottom and open top;

b) a throwable disk insert that is connected to the bag and comprised of first and second insert members;

c) the bag and insert being configured to fit together and be thrown in an initially collapsed position; and d) wherein the first insert member is a circular disk having a concavity that contains the bag in the collapsed position and the second insert member attaches to the first insert member in the collapsed position, wherein the bag is collapsed in between the first and second insert members.

12. A method of dispensing a parade throw from a parade float to a parade spectator comprising the steps of;

a) connecting an insert that has an outer surface to a bag so that at least part of the bag covers the outer surface of the insert, the insert having a disk shape and a central opening;

b) placing a portion of the bag into the opening of the insert, said portion of the bag conforming generally to the shape of the insert; and c) throwing the parade throw from the parade float to a parade spectator.

13. The method of claim 12 wherein the insert has a hollow interior and step "b" includes routing a portion of the bag into the opening of the insert and then into the hollow interior.

14. The method of claim 12 wherein in step "a", the stiff supporting insert includes two spaced apart panels and wherein a portion of the bag in step "b" comprises placing a portion of the bag in between the panels.

15. The method of claim 12 further comprising encapsulating the insert with the bag in steps "a" and "b".

16. The method of claim 12 wherein the insert has a concavity that defines the receptacle that holds the bag in step "b".

17. The method of claim 12 wherein the insert includes two members that hold the bag there between.

18. The apparatus of claim 12 wherein the insert is permanently attached to the bag.

19. A method of dispensing a throwable item from a selected location at a spectator event to a spectator, comprising the steps of;

a) attaching a stiff supporting insert member to a collapsible bag, said insert member having a generally disk shape, an outer surface, and a receptacle space;

b) placing a portion of the bag into the receptacle space of the insert until the bag conforms generally to the shape of the insert and wherein a portion of the bag covers the outer surface of at least part of the insert, the combination of the insert member and the bag defining the throwable item to be dispensed;

c) throwing the throwable item from the selected location to the spectator.

20. The method of claim 19 wherein the insert has a hollow interior and step "b" includes routing a portion of the bag into the opening of the insert and then into the hollow interior.

21. The method of claim 19 wherein in step "a", the stiff supporting insert includes two spaced apart panels and wherein a portion of the bag in step "b" comprises placing a portion of the bag in between the panels.

22. The method of claim 19 further comprising encapsulating the insert with the bag in steps "a" and "b".

23. The method of claim 19 wherein the insert has a concavity that defines the receptacle that holds the bag in step "b".

24. The method of claim 19 wherein the insert includes two members that hold the bag there between.

25. The apparatus of claim 19 wherein the insert is permanently attached to the bag.

* * * * *